US007270562B1

(12) United States Patent
Trout et al.

(10) Patent No.: US 7,270,562 B1
(45) Date of Patent: Sep. 18, 2007

(54) CONNECTOR WITH THUMB SCREW RETENTION MEMBER

(75) Inventors: David Allison Trout, Lancaster, PA (US); Richard Nicholas Whyne, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/397,183

(22) Filed: Apr. 4, 2006

(51) Int. Cl.
*H01R 13/627* (2006.01)

(52) U.S. Cl. ..... 439/364

(58) Field of Classification Search ..... 439/364, 439/362, 365, 902, 361
See application file for complete search history.

(56) References Cited

U.S. PATENT DOCUMENTS 3,056,942 A * 10/1962 Carbaugh et al. ..... 439/362
3,209,302 A * 9/1965 Uberbacher ..... 439/153
4,772,081 A * 9/1988 Borgos et al. ..... 385/89
5,295,756 A 3/1994 Ohta
5,419,714 A 5/1995 Nagamine
5,453,578 A 9/1995 Ishii et al.
6,059,599 A * 5/2000 Huang ..... 439/362
6,419,516 B1 * 7/2002 Parcet ..... 439/364
6,808,428 B1 * 10/2004 Korsunsky et al. ..... 439/680

* cited by examiner

*Primary Examiner*—Phuong Dinh

(57) ABSTRACT

An electrical connector includes a housing having a contact loading end and a locking member rotatably mounted in the housing and substantially enclosed within the connector. The locking member has a circumferential edge portion that is exposed through a window of the connector to permit finger rotation of the locking member. A backshell at least partially encloses the housing. The backshell includes a chamber between the contact loading end of the housing and a back wall of the backshell. The backshell includes side walls that have windows opening to the chamber to provide access to the edge portion of the locking member.

20 Claims, 7 Drawing Sheets

CONNECTOR WITH THUMB SCREW RETENTION MEMBER

BACKGROUND OF THE INVENTION

This invention relates generally to electrical connectors, and more specifically to a cable to board power connector assembly having a rotatable locking member.

Some electrical systems include one or more connectors that are removably mounted in a chassis. For instance, in some applications, power supplies may be slid into a chassis. The power supplies can be removed for service or replacement. Typically, a cable mounted connector mates with a header connector on a board in the power supply. Jackscrews are typically used to assure that the connectors are reliably mated. However, in some systems, the chassis or board is mounted in a case with a hinged or otherwise closeable cover which limits connector space. Cables must be negotiated out of the case and the connectors must remain reliably mated when the case is closed. Jackscrews are commonly used in pairs with one jackscrew at each end of the connector. A disadvantage associated with jackscrews is that one or more of the jackscrews may interfere with the closing of the cover.

When several connectors are mounted on a panel, cable routing may become more of a problem. Often cables must be turned or otherwise manipulated to exit the case. Typically, technicians forcibly bend the cables in order to route the cables in a desired direction. Care must be taken, however, to avoid damage to the cable that may result from excessive pulling or twisting on the cable. This problem is alleviated when the connector provides a right angle wire exit. In another disadvantage, the use of the typical two-jackscrew retention system generally precludes the provision of a right angle wire exit on the connector.

There is a need for a cable to board connector system that may be used in applications having a board mounted connector in a closed case that negotiates wires out of the case and keeps the connectors reliably mated when the case is closed.

BRIEF DESCRIPTION OF THE INVENTION

In one aspect, an electrical connector is provided. The connector includes a housing having a contact loading end and a locking member rotatably mounted in the housing and substantially enclosed within the connector. The locking member has a circumferential edge portion that is exposed through a window of the connector to permit finger rotation of the locking member.

Optionally, the connector further includes a backshell at least partially enclosing the housing. The backshell includes a chamber between the contact loading end of the housing and a back wall of the backshell. The backshell includes side walls that have windows opening to the chamber to provide access to the edge portion of the locking member. The locking member includes a head portion enclosed by the back wall that does not extend axially outside the backshell. The housing includes a mating end opposite the contact loading end and a channel extending therebetween, and the locking member includes a shaft rotatably held in the channel even when the housing is in an unmated condition. The backshell includes a cable exit through an end wall of the backshell that is substantially perpendicular to a mating direction of the housing. The locking member includes a shaft rotatably held in the channel. The shaft includes a shoulder formed thereon. The channel has a step formed therein. The shoulder engages the step to provide a locking force when the connector is in a locked condition.

In another aspect, a connector assembly is provided that includes a cable mounted connector that includes a housing having a contact loading end and a locking member rotatably mounted in the housing and substantially enclosed within the connector. The locking member has a circumferential edge portion that is exposed through a window of the connector to permit finger rotation of the locking member. A mating connector includes a mating connector housing configured to be mated with the housing of the cable mounted connector.

DETAILED DESCRIPTION OF THE INVENTION

Figure 1:
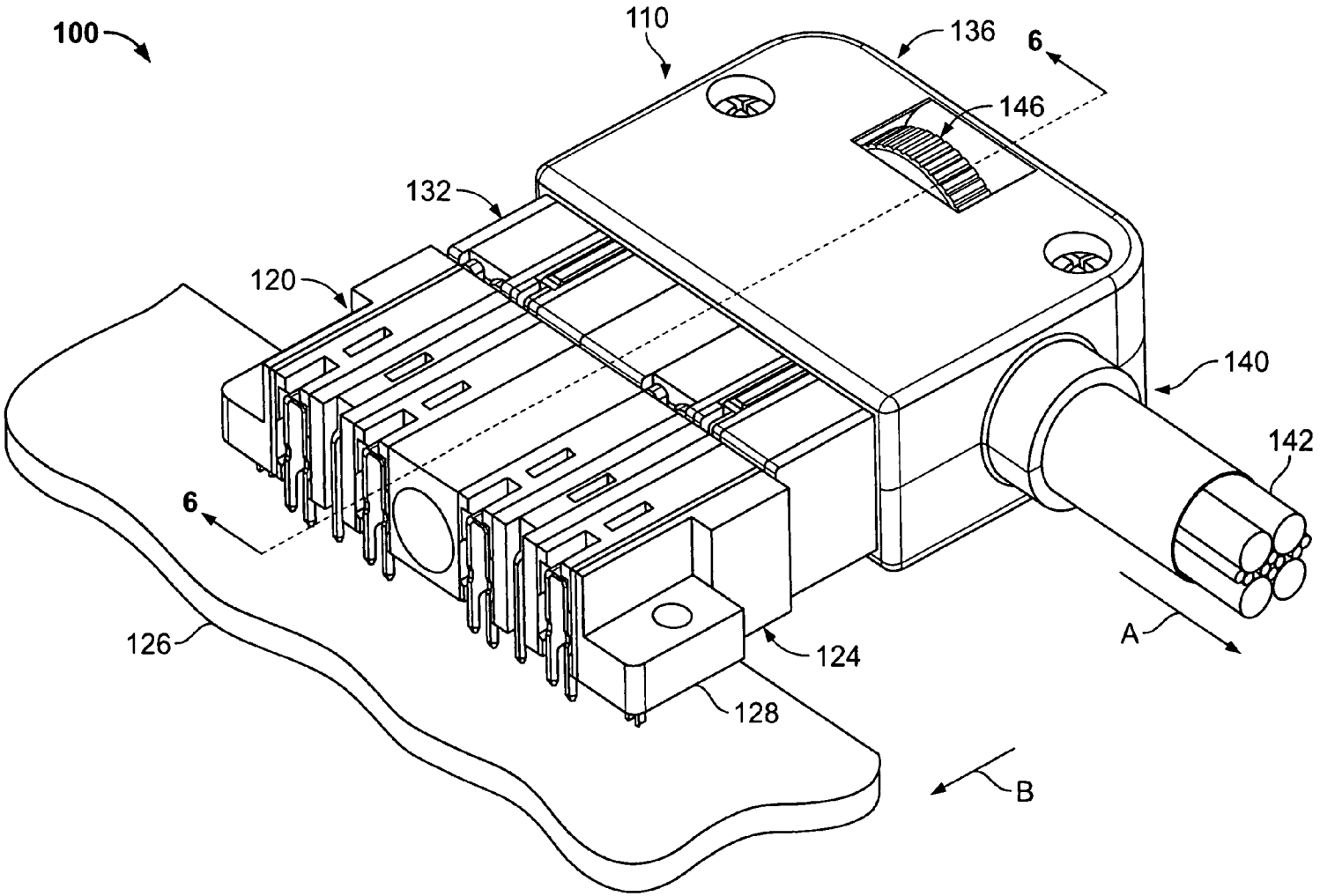
FIG. 1 is a perspective view of a connector assembly formed in accordance with an exemplary embodiment of the present invention.

FIG. 1 illustrates a perspective view of a connector assembly 100 formed in accordance with an exemplary embodiment of the present invention. The connector assembly 100 includes a cable mounted connector 110 and a mating connector 120. As shown in FIG. 1, the cable mounted connector 110 is in a mated condition with the mating connector 120. The mating connector 120 includes a housing 124 and, in an exemplary embodiment, the mating connector 120 is mounted on a circuit board 126. The mating connector housing 124 is provided with mounting flanges 128 that may be used with fasteners (not shown) to secure the mating connector 120 to the circuit board 126.

The cable mounted connector 110 includes a housing 132 that is held in a backshell 136. The backshell 136 is formed with a right angle wire or cable exit 140 such that a cable or wire bundle 142 exits the backshell 136 in the direction of the arrow A which is substantially perpendicular to the mating direction of the mating connector 120 as indicated by the arrow B. A locking member 146 is centrally located within the backshell 136.

Figure 2:
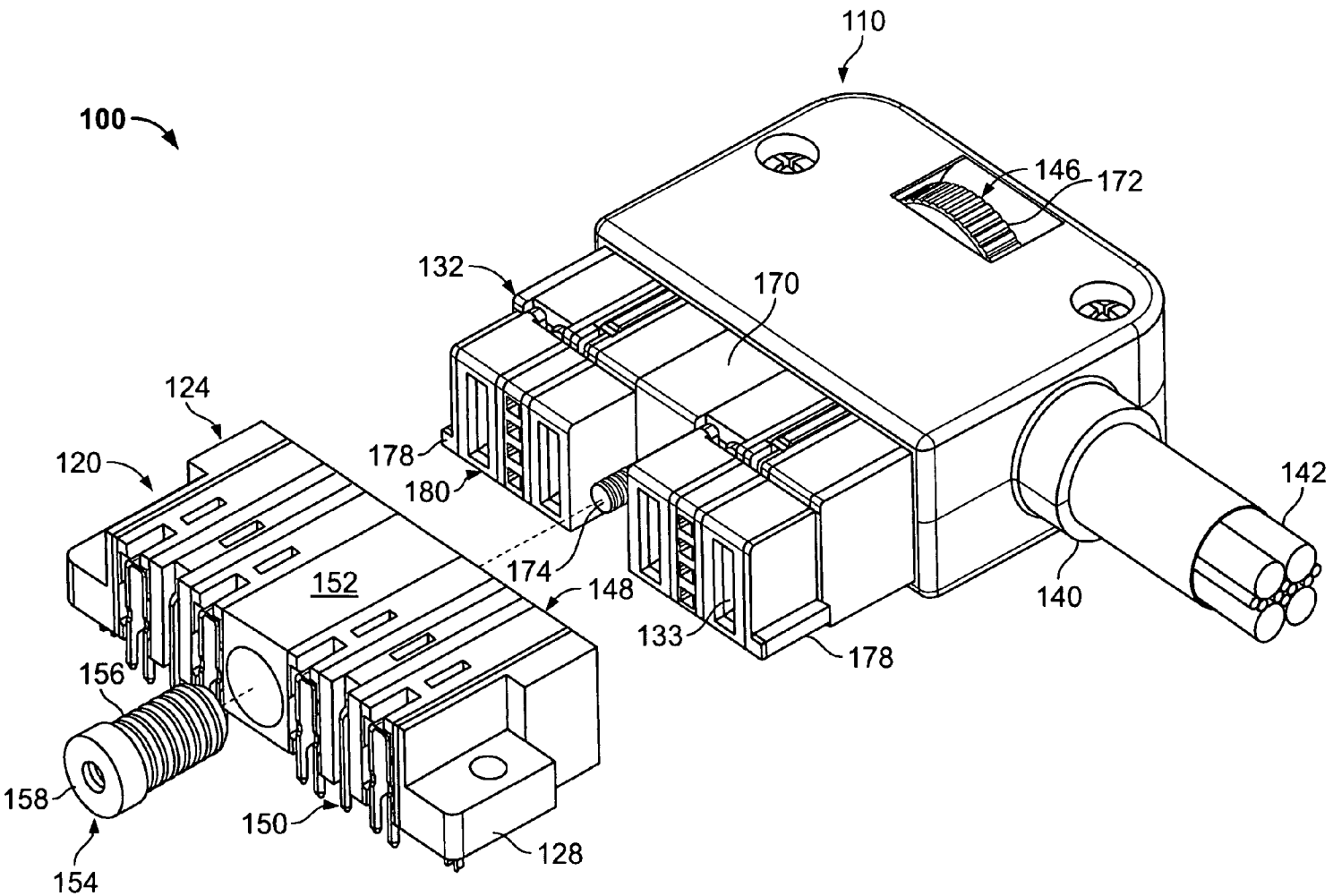
FIG. 2 is a front perspective view of the connector assembly shown in FIG. 1 in an unmated condition.

FIG. 2 illustrates a front perspective view of the connector assembly 100 in an unmated condition. The cable mounted connector housing 132 and the mating connector housing 124 are modular in construction. The mating connector housing 124 includes a mating end 148 and a mounting end 150. The mating connector housing 124 also includes a centrally positioned module 152 that receives an insert 154 that enables the cable mounted connector 110 and the mating connector 120 to be placed in a locked condition. In an exemplary embodiment, the insert 154 is a threaded insert that is received in the mating connector housing 124 with a press fit. The insert 154 includes a plurality of retention ribs 156 on an outer perimeter that facilitate retention of the insert 154 in the module 152 of the mating connector housing 124. The retention ribs 156 also enable the press fit installation of the insert 154 in the module 152. The insert 154 includes an enlarged rim portion 158 that prevents the insert 154 from being pulled through the mating connector housing 124 as the connectors 110 and 120 are placed in a locked condition as will be described.

The cable mounted connector housing 132 includes a centrally positioned module 170. The locking member 146 comprises a thumbscrew having a head portion 172 and an engagement end 174. The engagement end 174 extends through the module 170 proximate a mating end 180 of the cable mounted connector housing 132. The engagement end 174 of the locking member 146 is configured to engage the insert 154 to place the connectors 110 and 120 in a locked condition. In an exemplary embodiment, the engagement end 174 is threaded and configured to be received in the insert 154. The cable mounted connector housing 132 includes orientation keys 178. The housing 132 holds a series of contacts 133 proximate to a mating end 180 of the housing 132. The contacts 133 are joined to corresponding wires within wire bundle 142.

Figure 3:
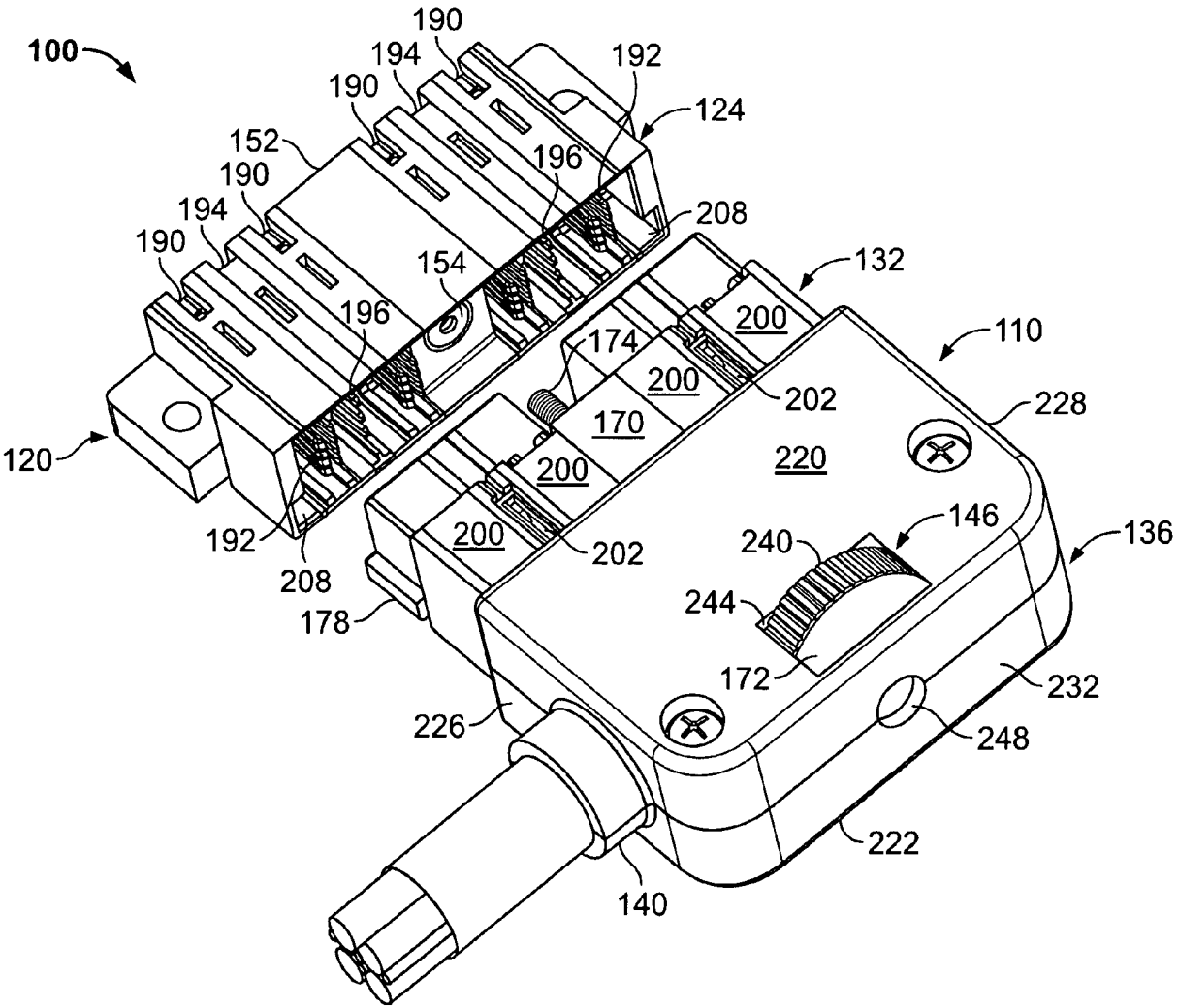
FIG. 3 is a rear perspective view of the connector assembly shown in FIG. 1 in an unmated condition.

FIG. 3 illustrates a rear perspective view of the connector assembly 100 in an unmated condition. The mating connector housing 124 includes power contact modules 190 that hold power contacts 192 and signal contact modules 194 that hold signal contacts 196. The cable mounted connector housing 132 includes power contact modules 200 and signal contact modules 202 holding power and signal contacts (not shown), respectively. Because the housings 124 and 132 are modularly formed, the arrangement of the power contact modules 190 and 200 and the signal contact modules 194 and 202 may be varied according to application requirements. The mating connector housing 124 is also provided with keying receptacles 208 that are complementary in shape with the orientation keys 178 and are configured to receive the orientation keys 178 on the cable connector housing 132 to orient the cable connector housing 132 and the mating connector housing 124 for mating.

The backshell 136 includes a first side wall 220, a second side wall 222 opposite the first side wall 220, a first end wall 226 and a second end wall 228 opposite the first end wall 226. A back wall 232 joins the side walls 220 and 222 and the end walls 226 and 228. The head portion 172 of the locking member 146 includes a circumferential edge portion 240 that is accessible through a window 244 provided in each side wall 220 and 222. An aperture 248 may be provided in the back wall 232 that provides access to the head portion 172 of the locking member 146. The locking member 146 continues to be retained in the backshell 136 when the connectors 110 and 120 are in an unlocked condition, and more specifically, when the mating connector housing 124 and the cable mounted connector housing 132 are in an unmated condition.

Figure 4:
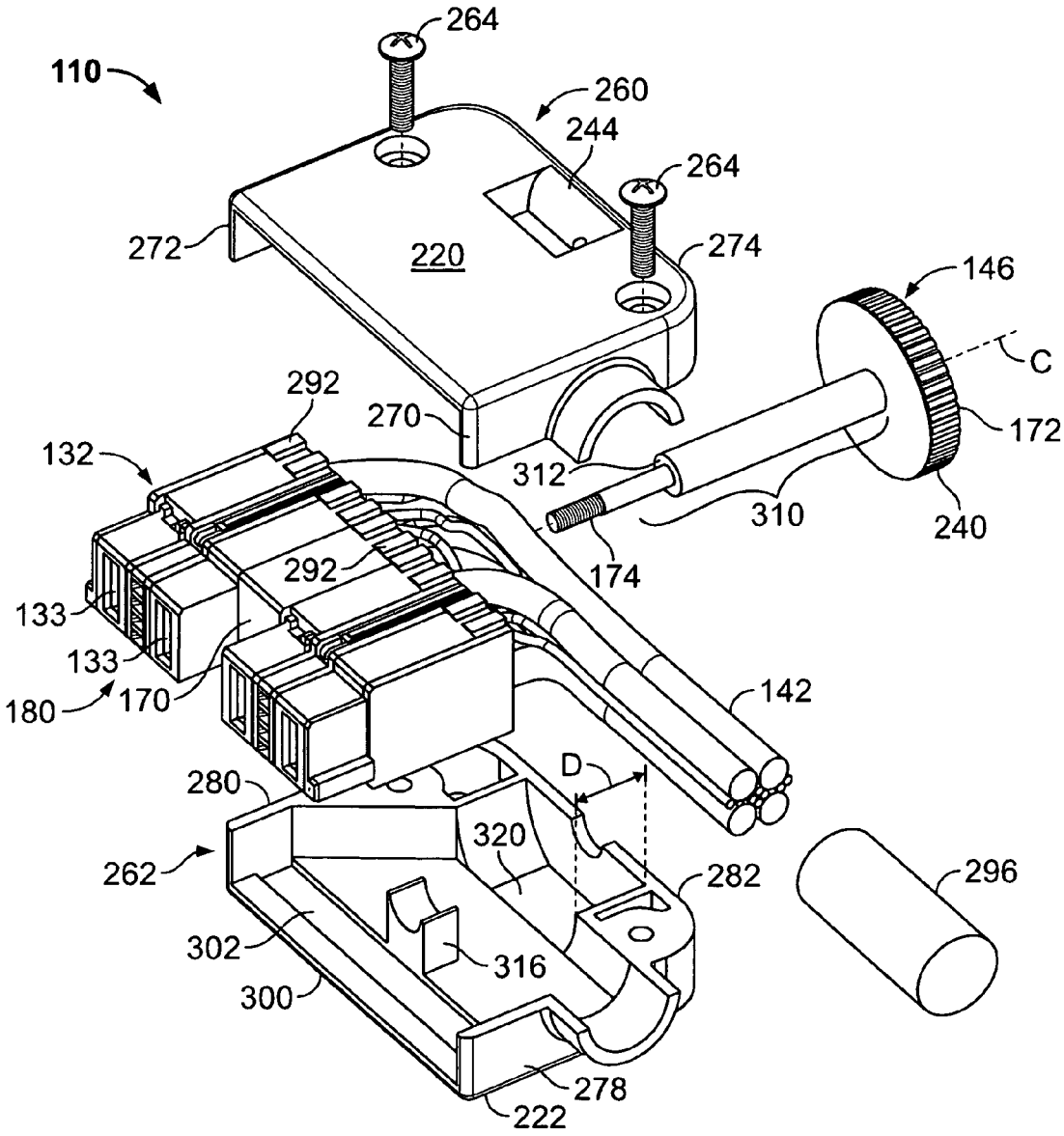
FIG. 4 is an exploded view of the cable mounted connector shown in FIG. 3.
Figure 5:
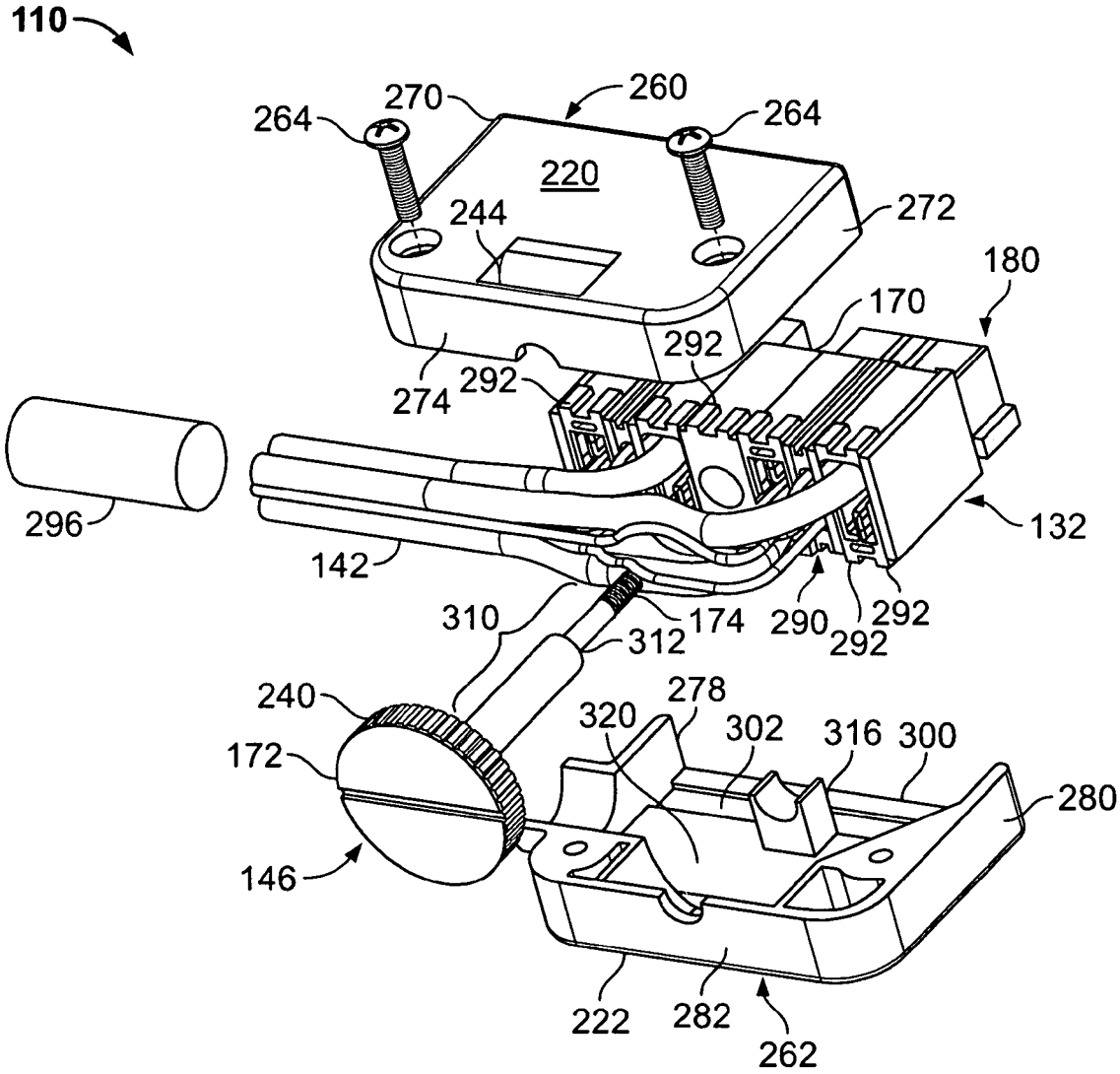
FIG. 5 is a rear exploded view of the cable mounted connector shown in FIG. 3.

FIG. 4 illustrates an exploded view of the cable mounted connector 110. FIG. 5 illustrates a rear exploded view of the cable mounted connector 110. With continued reference to FIG. 3, the backshell 136 includes an upper section 260 and a lower section 262 that are joined with fasteners 264. The upper section 260 includes the first side wall 220, a first upper end lip 270, a second upper end lip 272, and an upper back lip 274. The lower section 262 includes the second side wall 222, a first lower end lip 278, a second lower end lip 280, and a lower back lip 282. When the upper section 260 and lower section 262 are joined, the first upper end lip 270 and the first lower end lip 278 combine to form the first end wall 226. The second upper end lip 272 and the second lower end lip 280 combine to form the second end wall 228. The upper back lip 274 and the lower back lip 282 combine to form the back wall 232.

The cable mounted connector housing 132 includes a contact loading end 290 opposite the mating end 180. A plurality of retention ribs 292 are formed on the housing 132 proximate the contact loading end 290. The wire bundle 142 is arranged and routed toward the cable exit 140 in the end wall 226 such that individual wires are joined to corresponding contacts 133. A sleeve 296 is provided for cable management.

The backshell 136 has a receiving end 300 opposite the back wall 232. A retention channel 302 extends between the end wall lips 278 and 280 on the lower backshell section 262. A similar retention channel (not shown) is formed in the upper backshell section 260. When the upper and lower backshell sections 260 and 262 are combined, the retention channels 302 extend between the first and second end walls 226 and 228, respectively. The retention ribs 292 on the housing 132 are received in the retention channels 302 to lock the housing 132 in the backshell 136 when the upper and lower backshell sections 260 and 262, respectively, are joined.

The locking member 146 includes the head portion 172 and a shaft portion 310. The shaft portion 310 extends along an axis C from the head portion 172 and includes the engagement end 174. The engagement end 174 is necked down so that a shoulder 312 is formed on the shaft portion 310. The shaft portion 310 is received in the module 170 in the housing 132. The upper backshell section 260 and the lower backshell section 262 each includes a cradle 316 (not shown on the upper backshell section 260) that rotatably support the shaft portion 310 of the locking member 146 when the upper and lower backshell sections 260 and 262, respectively, are joined.

A chamber 320 is formed in the backshell 136 between the back wall 232 (FIG. 3) and the contact loading end 290 of the housing 132. The chamber 320 captures and rotatably retains the head portion 172 of the locking member 146 when the upper and lower backshell sections 260 and 262, respectively, are joined. The windows 244 in the first and second side walls 220 and 222, respectively, open into the chamber 320. The edge portion 240 of the head portion 172 of the locking member 146 is accessible through the windows 244. In one embodiment, the edge portion 240 of the head portion 172 may extend partially through the windows 244. The chamber 320 has a depth D that is sufficient to allow the locking member 146 to move axially, along the direction of the axis C, to lock and unlock the connectors 110 and 120 (FIG. 3). The head portion 172 does not extend axially outside of the backshell 136. The locking member 146 continues to be retained in the backshell 136 when the cable mounted connector 110 and the mating connector 120 are unlocked and/or separated from one another.

Figure 6:
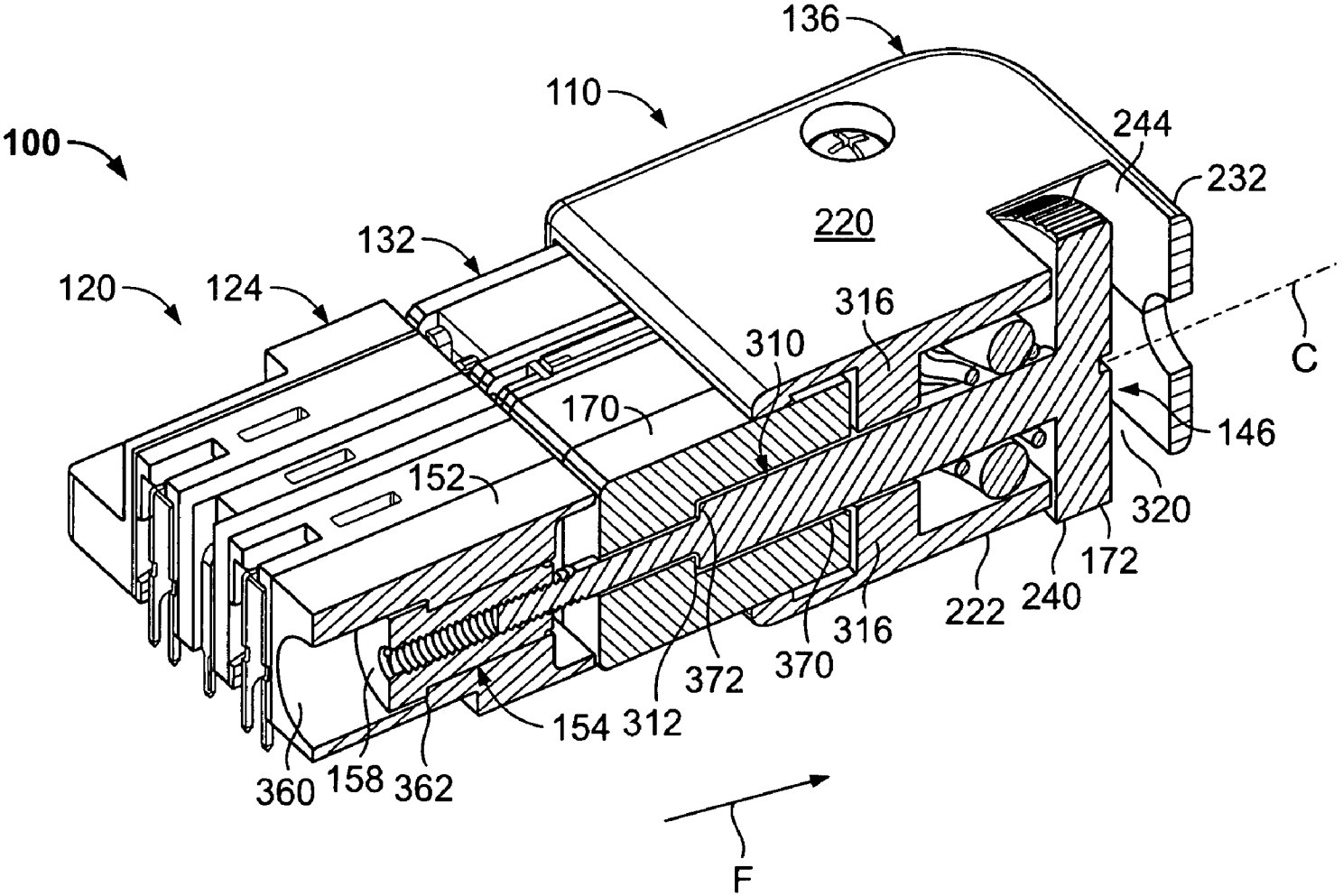
FIG. 6 is a cross sectional view of the connector assembly shown in FIG. 1 taken along the line 6-6 and shown in a locked condition.
Figure 7:
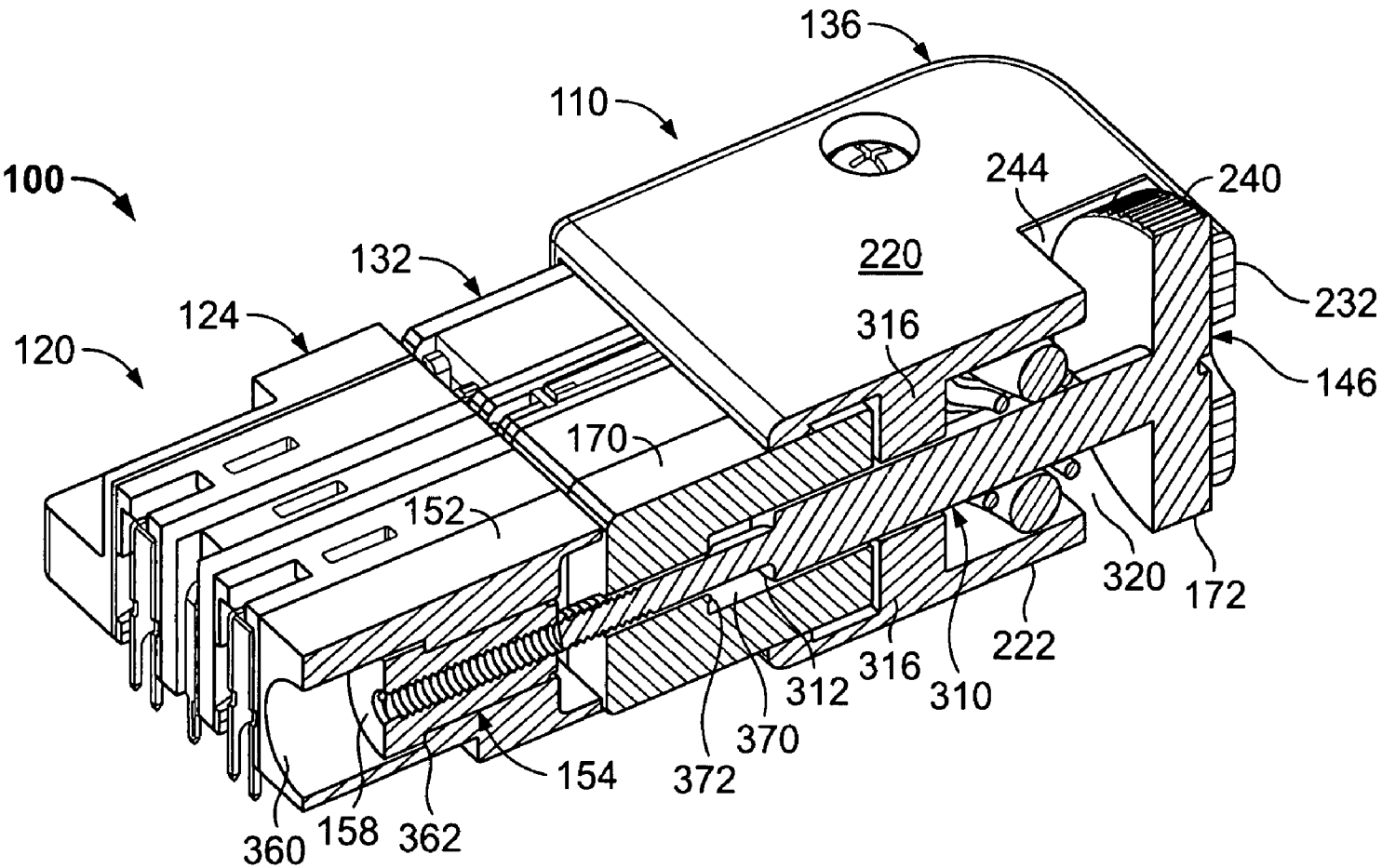
FIG. 7 is a cross sectional view of the connector assembly shown in FIG. 6 in an unlocked condition.

FIG. 6 is a cross sectional view of the connector assembly 100 taken along the line 6-6 in FIG. 1 and shown in a locked condition. FIG. 7 is a cross sectional view of the connector assembly 100 in an unlocked condition. In FIG. 6, the housing 132 of the cable mounted connector 110 is fully mated with the mating connector housing 124. The module 152 in the mating connector housing 124 includes a channel 360 having a step 362 formed therein. The insert 154 is received in the channel 360. The enlarged rim 158 of the insert 154 is sized to engage the step 362 in the channel 360. When the connectors 110 and 120 are placed in a locked condition, the locking member 146 draws the enlarged rim 158 against the step 362 to provide a locking force on the mating connector housing 124 as indicated by the arrow F.

The module 170 in the cable mounted connector housing 132 includes a channel 370 having a step 372 formed therein. The shaft portion 310 of the locking member 146 extends along the axis C and is received in the channel 370. The locking member 146 freely rotates within the channel 370 and chamber 320 about the axis C when unlocked. The back wall 232 on the back shell 136 prevents the locking member 146 from sliding out of the channel 370 when unlocked. The shoulder 312 on the shaft portion 310 is sized to engage the step 372 in the channel 370. When the cable mounted connector 110 and the mating connector 120 are placed in a locked condition, the locking member 146 draws the enlarged rim 158 of the insert 154 against the step 362 in the channel 360 and simultaneously the shoulder 312 on the shaft portion 310 of the locking member 146 is brought to bear against the step 372 to provide or augment the locking force F on the mating connector housing 124.

In FIG. 7, the connectors 110 and 120 are shown in a mated condition. However, the locking member 146 is withdrawn from the insert 154 such that no locking force is generated from the engagement of the enlarged rim 158 of the insert 154 with the step 362. There is also no locking force resulting from the engagement of the shoulder 312 on the shaft portion 310 of the locking member 146 with the step 372 in the channel 370. As shown, the head portion 172 of the locking member 146 continues to be held in the chamber 320.

The embodiments thus described provide a cable mounted connector 110 that is particularly suitable for use with a board mounted connector 120 housed in a cabinet or in a closed case. The cable mounted connector has a low profile and a ninety degree cable exit for limited space applications. A centrally mounted thumbscrew is provided to keep the connectors reliably mated. The thumbscrew continues to be retained in the cable mounted connector backshell with the head of thumbscrew not extending axially out of the cable mounted connector backshell. The cable mounted connector remains reliably mated to the board mounted connector when the case is closed. The centrally mounted thumbscrew balances the clamping load on the connectors while being positioned out of the wire exit area of the connector.

While the invention has been described in terms of various specific embodiments, those skilled in the art will recognize that the invention can be practiced with modification within the spirit and scope of the claims.

What is claimed is:

1. An electrical connector comprising:

a housing holding contacts, said housing having a contact loading end; and a locking member rotatably mounted in a channel formed in the housing and substantially enclosed within the connector, the locking member having a circumferential edge portion that is exposed through a window of the connector to permit finger rotation of the locking member.

2. The electrical connector of claim 1, further comprising a backshell at least partially enclosing said housing, said backshell including a chamber between said contact loading end of said housing and a back wall of said backshell, said backshell including side walls that have windows opening to said chamber to provide access to said edge portion of said locking member.

3. The electrical connector of claim 1, further comprising a backshell at least partially enclosing said housing, said backshell including a chamber between said contact loading end of said housing and a back wall of said backshell, and wherein said locking member includes a head portion enclosed by said back wall that does not extend axially outside said backshell.

4. The electrical connector of claim 1, further comprising a backshell at least partially enclosing said housing, and wherein said locking member comprises a thumbscrew having an edge portion that extends outward beyond at least one of opposed side walls of said backshell.

5. The electrical connector of claim 1, wherein said housing further includes a mating end opposite said contact loading end, said channel extending between said mating end and said contact loading end, and wherein said locking member includes a shaft rotatably held in said channel even when said housing is in an unmated condition.

6. The electrical connector of claim 1, further comprising a backshell at least partially enclosing said housing, wherein said backshell includes a receiving end opposite a back wall, said receiving end including a channel, said housing including a plurality of ribs that are received in said channel to lock said housing in said backshell.

7. The electrical connector of claim 1, wherein said housing includes a key configured to be received in a complementarily shaped receptacle in a mating connector to orient the housing with the mating connector.

8. The electrical connector of claim 1, further comprising a backshell at least partially enclosing said housing, said backshell including a cable exit through an end wall of said backshell that is substantially perpendicular to a mating direction of said housing.

9. The electrical connector of claim 1, wherein said housing further includes a mating end opposite said contact loading end, said channel extending between said mating end and said contact loading end, and wherein said locking member includes a shaft rotatably held in said channel, said shaft including a shoulder formed thereon, said channel having a step formed therein, said shoulder engaging said step to provide a locking force when the connector is in a locked condition.

10. A connector assembly comprising:

a cable mounted connector comprising:

a housing holding contacts, said housing having a contact loading end; and a locking member rotatably mounted in a channel formed in the housing and substantially enclosed within the connector, the locking member having a circumferential edge portion that is exposed through a window of the connector to permit finger rotation of the locking member; and a mating connector including a mating connector housing configured to be mated with said housing of said cable mounted connector.

11. The connector assembly of claim 10, wherein said cable mounted connector further comprises a backshell at least partially enclosing said cable mounted connector housing, said backshell including a chamber between said contact loading end of said cable mounted connector housing and a back wall of said backshell, said backshell including side walls that have windows opening to said chamber to provide access to said edge portion of said locking member.

12. The connector assembly of claim 10, wherein said cable mounted connector further comprises a backshell at least partially enclosing said cable mounted connector housing, said backshell including a chamber between said contact loading end of said cable mounted connector housing and a back wall of said backshell, and wherein said locking member includes a head portion enclosed by said back wall that does not extend axially outside said backshell.

13. The connector assembly of claim 10, wherein said cable mounted connector further comprises a backshell at least partially enclosing said cable mounted connector housing, and wherein said backshell includes a receiving end opposite a back wall, said receiving end including a channel, said cable mounted connector housing including a plurality of ribs that are received in said channel to lock said cable mounted connector housing in said backshell.

14. The connector assembly of claim 10, wherein said cable mounted connector housing includes a key configured to be received in a complementarily shaped receptacle in said mating connector housing to orient said cable mounted connector housing with the mating connector housing.

15. The connector assembly of claim 10, wherein said cable mounted connector housing wherein said housing further includes a mating end opposite said contact loading end, said channel extending between said mating end and said contact loading end, and wherein said locking member includes a shaft rotatably held in said channel, said shaft including a shoulder formed thereon, said channel having a step formed therein, said shoulder engaging said step to provide a locking force when the cable mounted connector is in a locked condition.

16. The connector assembly of claim 10, wherein the mating connector housing includes an insert received therein to enable said cable mounted connect and said mating connector to be placed in a locked condition.

17. The connector assembly of claim 10, wherein said mating connector housing includes a channel having a step formed therein and an insert received in said channel, said insert including an enlarged rim that engages said step to provide a locking force when said cable mounted connector and said mating connector are in a locked condition.

18. The connector assembly of claim 10, wherein said cable mounted connector further comprises a backshell at least partially enclosing said cable mounted connector housing, said backshell including a cable exit through an end wall of said backshell that is substantially perpendicular to a mating direction of said cable mounted connector housing.

19. The connector assembly of claim 10, wherein said cable mounted connector further comprises a backshell at least partially enclosing said cable mounted connector housing, and wherein said locking member comprises a thumbscrew having an edge portion that extends outward beyond at least one of opposed side walls of said backshell.

20. The connector assembly of claim 10, wherein said cable mounted connector housing further includes a mating end opposite said contact loading end, said channel extending between said mating end and said contact loading end, and wherein said locking member includes a shaft rotatably held in said channel even when said housing is in an unmated condition.

* * * * *